US006516582B2

(12) United States Patent
Paul et al.

(10) Patent No.: US 6,516,582 B2
(45) **Date of Patent: *Feb. 11, 2003**

(54) WALL ANGLE FOR USE IN SUSPENDED CEILING GRID STRUCTURE AND INCLUDING MULTI-PURPOSE MEASUREMENT INDICIA SUCH AS DIFFERENTLY CONFIGURED INDENTATION OR PUNCH-OUT PORTIONS

(76) Inventors: William Paul, 511 River Ridge Dr., Waterford Township, MI (US) 48327; Carol Paul, 511 River Ridge Dr., Waterford Township, MI (US) 48327

( * ) Notice: Subject to any disclaimer, the term of this patent is extended or adjusted under 35 U.S.C. 154(b) by 0 days.

This patent is subject to a terminal disclaimer.

(21) Appl. No.: 09/951,083

(22) Filed: Sep. 12, 2001

(65) Prior Publication Data

US 2002/0083656 A1 Jul. 4, 2002

Related U.S. Application Data

(63) Continuation-in-part of application No. 09/814,534, filed on Mar. 22, 2001, and a continuation-in-part of application No. 09/753,508, filed on Jan. 3, 2001.

(51) Int. Cl.[7] ..... E04B 9/00

(52) U.S. Cl. ..... 52/506.07; 52/105; 52/720.1; 52/730.6

(58) Field of Search ..... 52/105, 506.06, 52/506.07, 720.1, 730.6, 731.7

(56) References Cited

U.S. PATENT DOCUMENTS

| | | | | | |
|---|---|---|---|---|---|
| 1,714,174 | A | * | 5/1929 | Lichtenberg et al. | 52/105 |
| 2,920,357 | A | * | 1/1960 | Ericson | 52/198 X |
| 3,084,401 | A | * | 4/1963 | Findlay | 52/476 |
| 3,302,355 | A | * | 2/1967 | Chinneck | 52/506.06 |
| 3,370,301 | A | * | 2/1968 | Harlan | 52/731.7 X |
| 3,374,596 | A | * | 3/1968 | O'Brien et al. | 52/105 X |
| 3,473,282 | A | * | 10/1969 | Robinson, Jr. | 52/664 |
| 3,979,874 | A | | 9/1976 | Cubbler, Jr. et al. | |
| 4,161,856 | A | | 7/1979 | Brown et al. | |
| 4,406,104 | A | | 9/1983 | Beck et al. | |
| 4,470,239 | A | | 9/1984 | Sauer | |
| 4,505,083 | A | | 3/1985 | Mieyal | |
| 4,525,973 | A | | 7/1985 | Vukmanic et al. | |
| 4,624,088 | A | * | 11/1986 | Arent | 52/506.07 |
| 4,677,802 | A | | 7/1987 | Vukmanic | |
| 4,712,350 | A | | 12/1987 | Vukmanic | |
| 4,727,703 | A | | 3/1988 | Platt | |
| 4,923,032 | A | | 5/1990 | Nuernberger | |
| 4,927,696 | A | * | 5/1990 | Berg | 52/105 X |
| 5,044,138 | A | | 9/1991 | Zaccardeli et al. | |
| 5,046,294 | A | * | 9/1991 | Platt | 52/506.06 |
| 5,216,865 | A | | 6/1993 | Lalonde et al. | |
| 5,222,335 | A | * | 6/1993 | Petrecca | 52/105 |
| 5,655,330 | A | * | 8/1997 | Parsons, III | 52/105 X |
| 5,839,246 | A | | 11/1998 | Ziegler et al. | |
| 5,966,887 | A | | 10/1999 | Mieyal | |
| 6,047,511 | A | | 4/2000 | Lehane et al. | |
| 6,269,595 | B1 | * | 8/2001 | Blubaugh et al. | 52/105 |

* cited by examiner

*Primary Examiner*—Carl D. Friedman
*Assistant Examiner*—Brian E. Glessner
(74) *Attorney, Agent, or Firm*—Gifford, Krass, Groh, Sprinkle, Anderson & Citkowski, P.C.

(57) ABSTRACT

A wall angle for use in installing a suspended ceiling grid structure within a walled enclosure, the grid structure including a plurality of main grid runners and hanger wires suspending the main runners from an overhead support of the room enclosure. The wall angle includes an elongated body defining, in cross section, an angled profile with a first side and a second interconnecting and extending side. At least one series of punch-out, die pressed, indented or etched markings are placed at pre-selected length intervals along the body and for marking iterative locations for such as engagement of the main runners and hanger wires and marking locations for engagement of the wall angle to vertically extending wall studs of the walled enclosure.

21 Claims, 6 Drawing Sheets

WALL ANGLE FOR USE IN SUSPENDED CEILING GRID STRUCTURE AND INCLUDING MULTI-PURPOSE MEASUREMENT INDICIA SUCH AS DIFFERENTLY CONFIGURED INDENTATION OR PUNCH-OUT PORTIONS

CROSS REFERENCE TO RELATED APPLICATIONS

The present application is a continuation-in-part of U.S. application Ser. No. 09/814,534, filed Mar. 22, 2001, for a Wall Angle for Use in Suspended Ceiling Grid Structures and Including Multi-Purpose Measurement Indicia, in turn a continuation-in-part of U.S. application Ser. No. 09/753,508, filed Jan. 3, 2001, for a Suspended Ceiling Grid Structure with Main Runners Incorporating Coded Matching Indicia for Receiving Cross Runners in Desired Spaced Apart Fashion.

BACKGROUND OF THE PRESENT INVENTION

1. Field of the Invention

The present invention relates generally to suspended ceiling grid structures and, more particularly, to a wall angle employed in suspended ceiling grid structures and which incorporates various measurement indicia schemes including, in particular, indentation and/or punch-out portions corresponding to the measurement scheme employed with the wall angle. The measurement indicia schemes incorporated into the wall angle according to the instant invention provide the combined feature of wall stud location, main suspended runner and hanger wire location and vertical height "story pole" location and which enable proper location of a grid structure.

The further preferred variant of the measurement indicia scheme discloses sectioning portions of the wall angle corresponding to the distance markings and without sacrificing the structural integrity of the wall angle. The present invention further contemplates utilizing a diamond hole, round punch, triangular punch or other suitable implement to indent or section portions of the wall angle in order to provide the necessary indicia representations.

2. Description of the Prior Art

Suspended structures for creating ceiling grids are fairly well known in the art, the concept behind such structures being to provide suspended support for ceiling tiles. The tiles are typically rectangular shaped and acoustically insulating in nature and function to recreate a uniform and "dropped" ceiling appearance to an interior enclosure with an unfinished ceiling, such enclosures including commercial building interiors, as well as basement ceilings in residential dwellings.

U.S. Pat. No. 4,677,802, issued to Vukmanic, discloses one known arrangement of suspended ceiling system and runner and which is characterized by each of the runners being composed of a first member and a cap member. The first member is bent to form an inverted T-bar configuration with a groove extending inwardly from the flange of the T and the cap member having the same configuration and being secured on the flange of the T-bar configuration to form a channel with flange portions on each side for supporting panels of the ceiling system.

U.S. Pat. No. 4,712,350, also issued to Vukmanic, discloses a centering arrangement for T members of a suspended ceiling for holding a plurality of panels supported by the runners in a desired position on the flanges of the runners. The centering arrangement includes a bump extending from each side of a cross sectional web profile of the runner, the bump being formed in the web immediately adjacent a cut in the runner so that the drawing of the material into the bump will not draw material from the flange or adjacent thereto. The bump shape is preferably "half-moon" or semi-circular in configuration and so that it provides a smooth camming surface for both lateral movement of the panel along the flange as well as vertical movement towards the flange.

U.S. Pat. No. 4,525,973, again issued to Vukmanic, teaches a suspended ceiling system again teaching main runners and cross runners which are inter-engageable to define a rectangular grid system. Suitably configured and elongated apertures are formed in the webbed profile of the main runners in axially spaced apart fashion and which receive an appropriately configured connecting end of selected cross runners and so that the cross runners are engaged to the main runner in mutually engaging fashion and on opposite sides thereof.

Finally, U.S. Pat. No. 4,406,104, issued to Beck et al., teaches a suspended ceiling wall angle including a conventional inverted "T" ceiling runner structure used as a wall angle molding for a suspended ceiling system. Appropriate spacing means are utilized adjacent the vertical web of the inverted T runner to space the vertical web from a vertical wall so that the runner may be mounted in position with its horizontal flanges in a horizontal plane perpendicular to the wall.

Additional examples of suspended ceiling grid systems are illustrated by the likes of U.S. Pat. No. 4,470,239, issued to Sauer; U.S. Pat. No. 4,727,703, issued to Platt; and U.S. Pat. No. 5,839,246, issued to Ziegler.

SUMMARY OF THE PRESENT INVENTION

The present invention is a wall angle construction for use in installing a suspended ceiling grid structure within an interior enclosure which is an improvement over the prior art in that the wall angle can be employed in any one of a number of different measuring and marking applications to dramatically decrease the length of time necessary to install the suspended ceiling structure. Specifically, the wall angle of the present invention may be utilized on lieu of the standard measuring tape in order to quickly and effectively establish highly accurate measurements for such as the location of main grid runners and hanger wire, the marking of stud locations along each of the walls defining the interior enclosure and the establishing of a desired and overall height and/or length of the grid structure (including positioning of 4' tees).

The wall angle defines an elongated body having, in cross section, an angled profile with a first side and a second side extending from an interconnecting edge with the first side. The wall angle is further preferably constructed of a durable and resilient material, such as a lightweight steel, and is typically provided in twelve foot lengths. A first series of markings are placed at selected one foot length intervals along the body and for marking first iterative locations for engagement of the main runners and hanger wires (4' tees). The markings are preferably inscribed along both the first and second sides of the body and exhibit a selected and alternating color scheme to better assist the installer in visualizing and identifying the correct location of the main ceiling grid runners.

A second series of markings are placed at second selected intervals, typically at either sixteen or twenty-four inches, and define locations for engaging the wall angle to the vertically extending studs forming a part of the wall structure. A third series of markings are placed at third selected intervals along the body and assist in such as the establishing of an overall height to the suspended grid structure. The third series of markings may include cut-out or incised portions which permit the application of a marking indicia and so that the wall angle may be employed as a "story pole" to set the height of the drop ceiling grid structure and to determine the height and position at which a laser level may be established at a location where a four foot (4') tee does not fall or interfere with the laser, as well as establishing parallel wall locations for affixing further lengths of wall angle and the main grid runners.

It is also contemplated that a fourth series of markings may be employed at fourth selected intervals, such preferably being six inch increments between each foot marker corresponding to the first series of markings. Further, the wall angle may be provided as a substantially flattened blank and prior to a bending operation in which it acquires its angular configuration.

An additional variant of the measurement indicia scheme discloses, as an alternative to using ink jet print, paint or other colorized or indicia type marking, sectioning portions of the wall angle corresponding to the distance markings and doing so without sacrificing the structural integrity of the wall angle. The present invention further contemplates utilizing a diamond hole, round punch, triangular punch or other suitable implement to indent or section portions of the wall angle in order to provide the necessary indicia representations and such stamping, punching or sectioning operation can be incorporated into a conventional line for manufacturing the wall angle.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
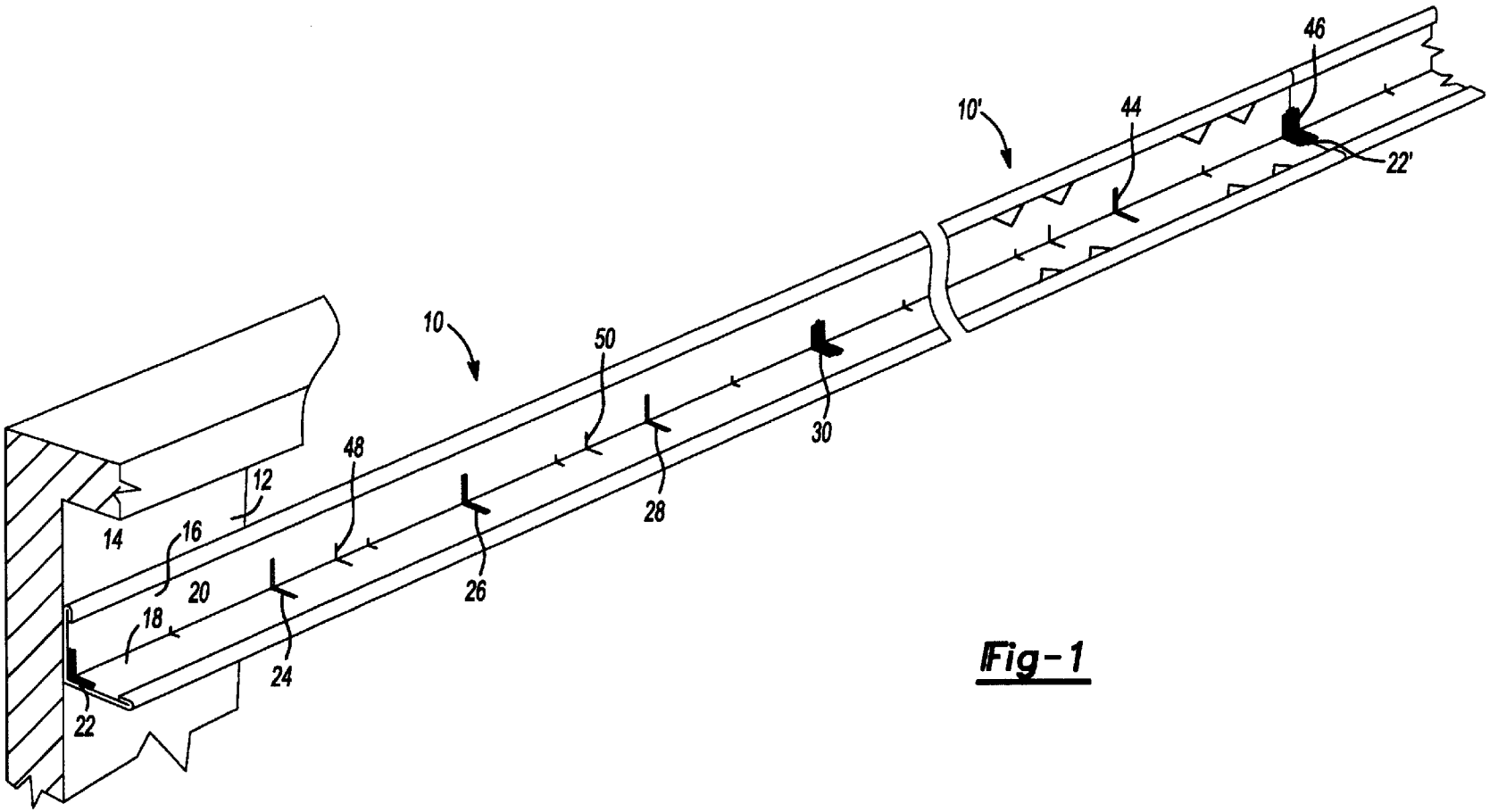
FIG. 1 is a perspective view of the wall angle, shown in reduced length for each of presentation, and according to the present invention.

Referring now to FIG. 1, a wall angle construction is illustrated at 10 for use in installing a suspended ceiling grid structure (not illustrated) within an interior enclosure (walled enclosure 12 and overhead ceiling or support 14). As previously stated, the wall angle 10 is an improvement over the prior art in that it can be employed in any one of a number of different measuring and marking applications and in order to dramatically decrease the time and effort necessary to install the suspended ceiling structure. The items comprising the drop ceiling grid structure, including the main runners, cross runners, and hanger wire, are known in the art and do not require repeating herein. The wall angle of the present invention is also equally applicable for use with any conventional types of suspended ceiling grid assemblies.

As further previously described, the wall angle of the present invention takes the place of the standard measuring tape in order to quickly and effectively establish highly accurate measurements for such as the location of main grid runners and hanger wire, the marking of stud locations along each of the walls defining the interior enclosure and the establishing of a desired and overall height and/or length of the grid structure.

Referring again to FIG. 1, the wall angle 10 defines an elongated body having, in cross section, an angled profile with a first side 16 and a second side 18 extending from an interconnecting edge 20 with the first side 16. The wall angle 10 is further preferably constructed of a durable and resilient material, such as a lightweight steel, and is typically provided in twelve foot running lengths.

Figure 2A:
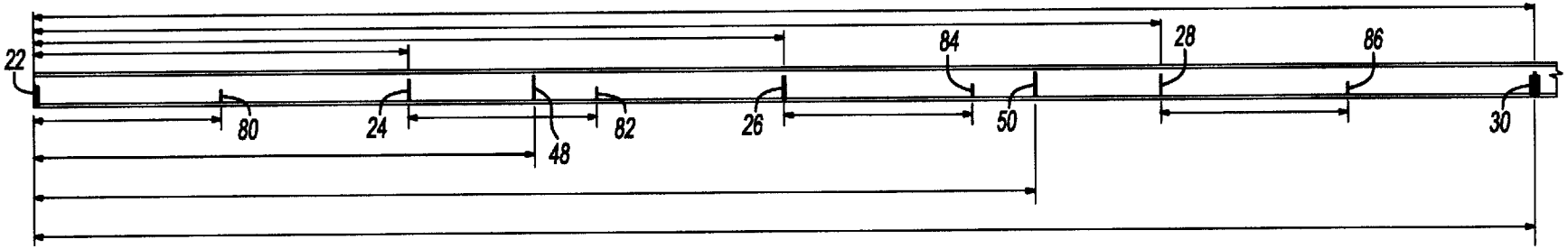
FIG. 2*a* is a front plan view of a first four foot section of the wall angle and illustrating portions of the first and second marking indicia according to the present invention.

Referring again to FIG. 1, as well as to FIGS. 2*a*, 2*b* and 2*c* in succession, a plurality of individual and incremental marking indicias will now be described and with which the wall angle of the present invention is employed in its various functions. Specifically, a first series of markings are placed at selected one foot length intervals along the body and for marking first iterative locations for engagement of the main runners and hanger wires. Accounting for the twelve (12) foot overall length of the wall angle 10, the first series of markings are as follows: zero feet (22), one foot (24), two feet (26), three feet (28), four feet (30), five feet (32), six feet (34), seven feet (36), eight feet (38), nine feet (40), ten feet (42), eleven feet (44) and twelve feet (46). As further illustrated in FIG. 1, a succeeding and end-to-end engaging wall angle 10' is illustrated and includes an initial marker 22' (designating zero feet).

The markings 22, 24, 26, 28, 30, 32, 34, 36, 38, 40, 42, 44 and 46 are preferably inscribed along both the first 16 and second 18 sides of the body (and along the interconnecting edge 20) and each exhibits a selected and alternating color scheme to better assist the installer in visualizing and identifying the correct location of the main ceiling grid runners. A preferred variant contemplates the color coded markings exhibiting a scheme of combined red and green stripes at 22, 30, 38 and 46 (corresponding to 0, 4, 8 and 12 foot locations), white coded markings at 24, 32 and 40 (corresponding to 1, 5 and 9 foot locations), blue coded markings at 26, 34 and 42 (corresponding to 2, 6 and 10 foot locations), and green coded markings at 28, 36 and 44 (corresponding to 3, 7 and 11 foot locations).

The purpose of the color coding is to provide quick and easy color association of correct main runner and hanger wire locations. The four foot 30, eight foot 38, and abutting end-to-end twelve foot 46 to zero foot 22' locations each further define blue/red/blue color designations to identify the proper four foot locations for installation of main runners in a 4×2 ceiling grid. It is also contemplated that color coding indicia can be employed with the first series of markings 22–46 without departing from the present scope of the invention.

A second series of markings are placed at second selected intervals, typically at sixteen inches, and define locations for engaging the wall angle 10 to vertically extending studs (forming a portion of the wall structure of the room enclosure 12 and as is conventionally known in the art). In the embodiment illustrated, and referring to both FIG. 1 and 2*a*, the first four foot section of the wall angle includes a second series of markings provided at 48 (corresponding to sixteen inches), 50 (corresponding to thirty-two inches), and again at 30 (corresponding also to the four feet designation indicia associated also with the first series of markings).

Figure 2B:
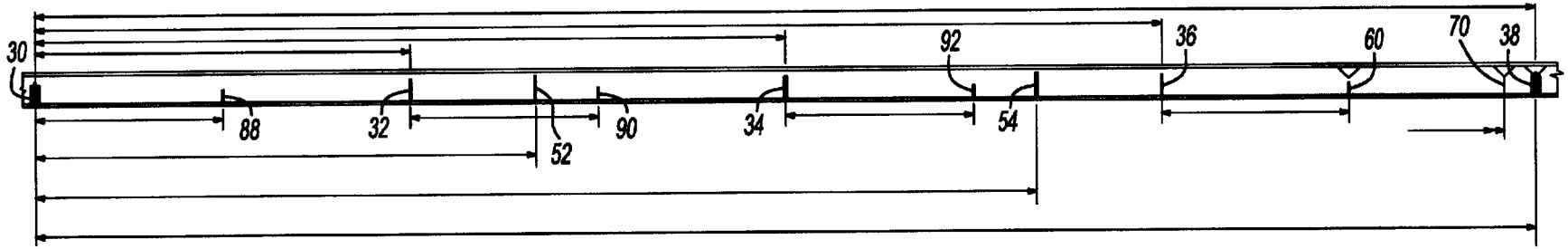
FIG. 2*b* is a front plan view of a second four foot section of the wall angle and illustrating portions of the first, second and third marking indicias according to the present invention.
Figure 2C:
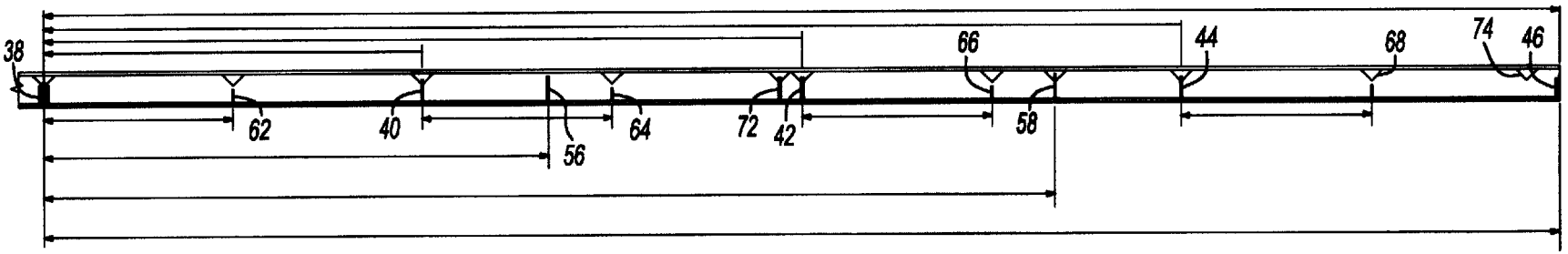
FIG. 2*c* is a front plan view of a third four foot section of the wall angle and illustrating additional portions of the first, second and third marking indicias according to the present invention.

Referring to FIG. 1 and to the second four foot portion of FIG. 2*b*, additional and succeeding designations of the second series of markings further include 52 (64 inches), 54, (80 inches), again at 38 (at 8 feet or at 96 inches). Referring finally again to FIG. 1, and to the third four foot section of FIG. 2*c*, yet additional and succeeding designations of the second series of markings further include 56 (112 inches), 58 (128 inches) and again at 46 (12 feet or 144 inches).

The sixteen inch separation of the second series of markings, including in succession 48, 50, 30, 52, 54, 38, 56, 58 and 46, correspond to the conventional sixteen inch on-center construction of studs in most residential and commercial constructions. In the event of a construction in which twenty fourth inch on-center studs are employed, the subset markings 26, 30, 34, 38, 42 and 46 (drawn from the first series of markings 22–46) may be employed to mark the appropriate stud locations (such as beneath the wall covering material) and for subsequent affixation of the wall angle 10.

A third series of markings are placed at third selected intervals along the body and assist in such as the establishing of an overall height or length of the suspended grid structure. In this application, the wall angle is employed in a "story pole" application. The third marking indicia markings are provided at increments beginning at an initial established length of seven foot, six inches (see at 60 in FIG. 2*a*) along said elongated body, and repeating at six inch increments thereafter, i.e., also at 38 corresponding to eighth foot designation of the first marking series. Additional six inch increments are illustrated in the third four foot portion of FIG. 2*c* at 62 (8'6"), again at 40 (9'), at 64 (9'6"), again at 42 (10'), at 66 (10'6") again at 44 (11'), at 68 (11'6") and again at 46 (12'). Additional third series markings at further designated increments are provided and include locations at seven foot-eleven inches (at 70 in FIG. 2*b*), as well as at nine foot-eleven inches 72 and eleven foot-eleven inches 74 and referring further to the third four foot portion illustrated in FIG. 2*c*).

Figure 5:
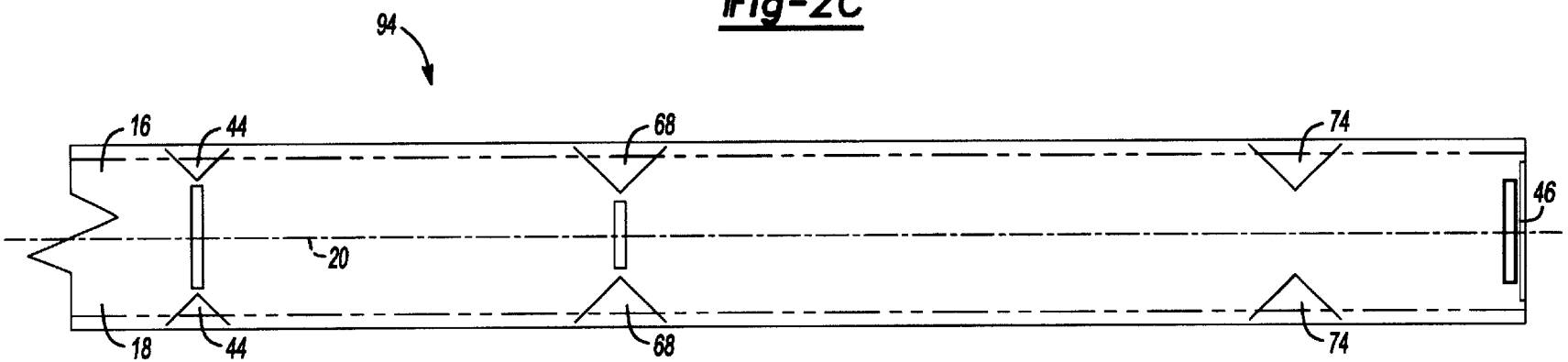
FIG. 5 is a front plan view illustrating the wall angle as a substantially flattened blank and in which the first and second sides are arranged in substantially planar fashion.
Figure 4:
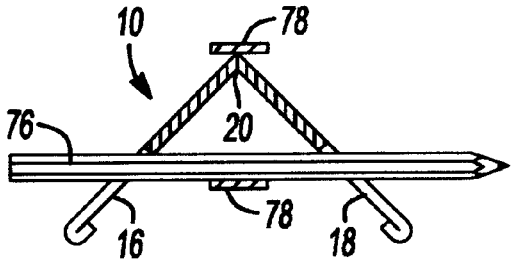
FIG. 4 is a cutaway view, taken along line 3—3 of FIG. 3, and illustrating the manner in which the marking indicia is located and resiliently engaged within a channel defined by the incised portions of the third marking indicia.

Referring also to FIGS. 4 and 5, the third series of markings are each inscribed as a pair of markings along both the first 16 and second 18 sides of the wall angle body 10. Referring again to FIG. 5, the wall angle 10 is illustrated in a vertically extending and "story pole" arrangement in which a selected pair of the individual third series markings is utilized to mark an appropriate height within the enclosure. This is accomplished for such purposes as the establishment of a laser (not shown) to guide the subsequent installation and attachment of the wall angle and/or the main tees of the suspending grid.

Figure 3:
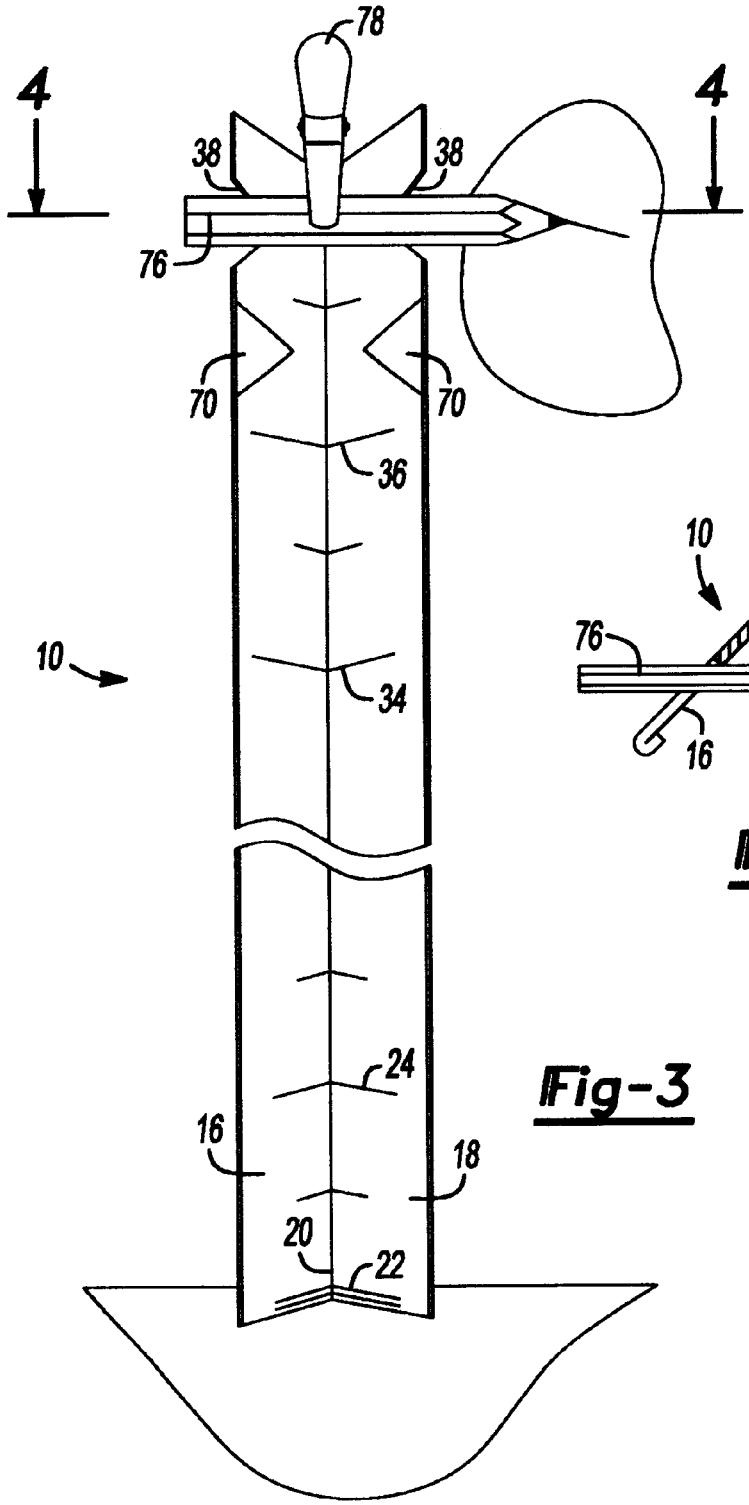
FIG. 3 is an elevational view of the wall angle utilizing a selected third marking indicia and in use as a height establishing story pole.

As is best shown in FIG. 5, the pairs of third marking indicia are established in opposing and substantially polygonal shape, and such as is represented by opposing triangular portions 70 corresponding to the seven foot, eleven inch location along the wall angle 10. The further story pole pair at 38 (corresponding to the eight foot marking location in each of the first, second and third marking series) is illustrated with the triangular portions having been incised or cut away, such as through the use of aviation snips (not shown) or other appropriate cutting tool. The incised portions of the selected pair of third series markings 38 define a channel within which a marking indicia (see pencil 76) is resiliently engaged against the wall angle body 10, and such as through the use of a clamp 78 or other suitable means for securing the marking indicia to the wall angle. Further, and while the example illustrated in FIGS. 3 and 4 shows the story pole being marked at an even eight feet, it has also been determined in practice that a ceiling height marking one inch less than the 8', 10' and 12' increments (referring again to the markings 70, 72 and 74 respectively) provides for the most correct location of the wall angle and prior to the location and attachment of the main ceiling grid runners.

It is also contemplated that a fourth series of markings may be employed at fourth selected intervals, such preferably being six inch increments between each foot marker corresponding to the first series of markings. Reference is again made to FIGS. 1 and 2*a*–2*c* and illustrating six inch markers 80 (at 6"), 82 (at 1'6"), 84 (at 2'6"), 86 (at 3'6"), 88 (at 4'6") at 90 (5'6"), at 92 (at 6'6"), and so on up to the end of the full twelve foot length. The purpose of the fourth series of six inch markings is varied and provides the user with additional options and flexibility for establishing the appropriate measurements.

Referring to FIG. 5, the wall angle may be provided as a substantially flattened blank 94, with the first 16 and second 18 sides arranged in substantially planar fashion and prior to a bending operation in which it acquires its substantially right angle configuration. Any conventional bending operation can be employed to provide the wall angle with its desired configuration and, further, it is envisioned that the user can mark the appropriate or desired indicia locations prior to the bending operation.

Figure 6:
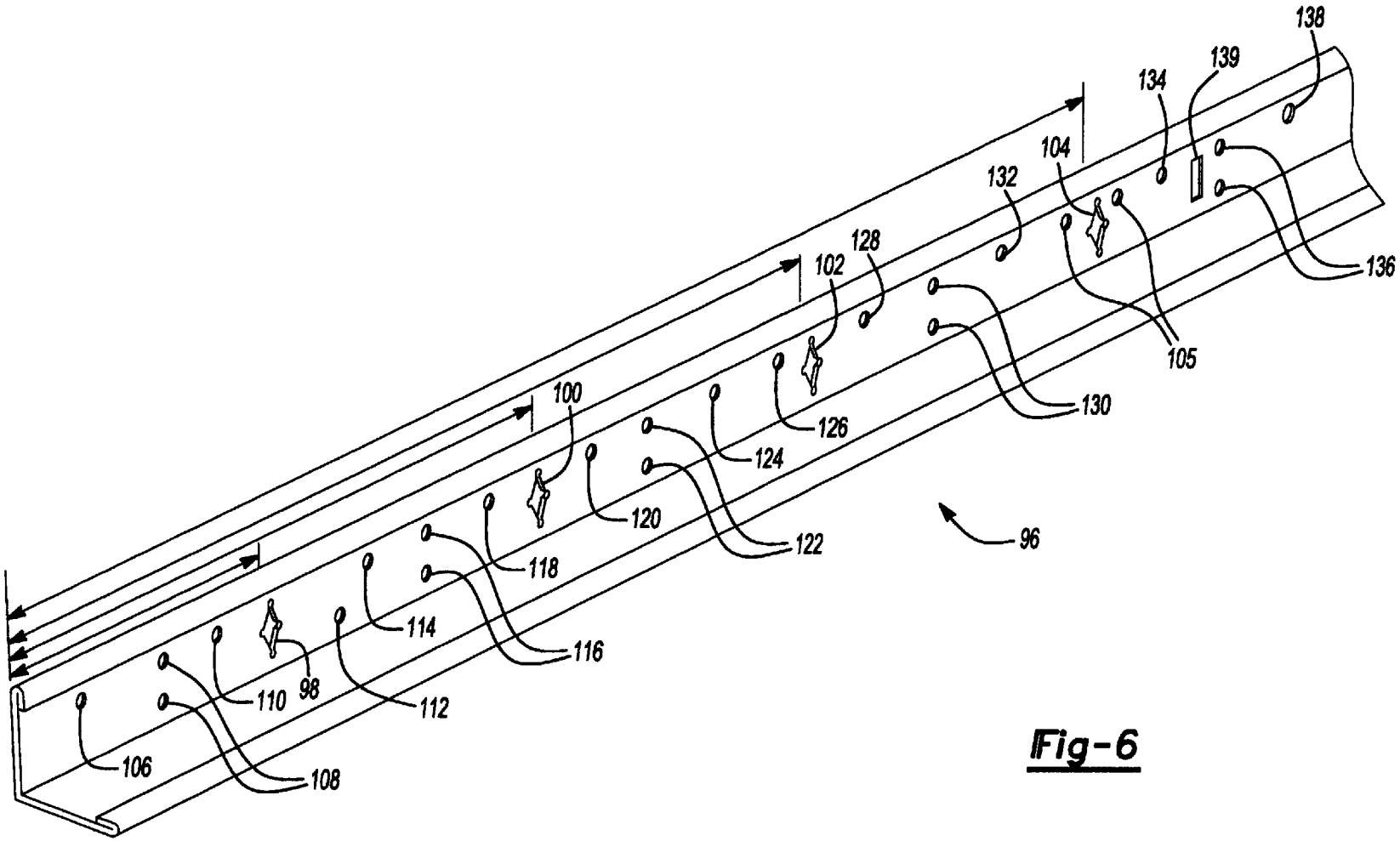
FIG. 6 is a perspective view of the wall angle, shown in reduced length for each of presentation, and according to a further preferred variant of the present invention.

Referring now to FIG. 6, a perspective view is illustrated generally at 96 of a wall angle, shown in reduced length, and according to a further preferred variant of the present invention. The measurement scheme associated with the wall angle 96 illustrates an initial four foot length, corresponding to that set forth in the previous illustration of FIG. 2A, and in comparison to that previously identified (such as at 10 in FIG. 1 and which teaches utilizing ink jet print, paint or other suitable colorized or alternate type of marking indicia). In contrast to the earlier disclosed embodiment 10, the wall angle 96 discloses instead sectioning portions of the wall angle 96 corresponding to the distance markings and doing so without sacrificing the structural integrity of the wall angle.

Specifically, the example of the wall angle set forth at 96 illustrates a number of cut-out portions, subset groupings of which are presented as specific shapes for corresponding to distinctive measurement intervals. A first example of this includes the foot markings identified at 98 (1'), 100 (2'), 102 (3') and 104 (4'). Each 1' marking is in the form of a substantially diamond-shaped punch out and the 4' marking is further identified by a pair of proximately located and sectioned circular apertures (defined by associated inwardly facing and annular shaped holes 105).

The wall angle 96 is illustrated in illustrated in reduced length fashion (terminating shortly after the 4' marking 104), however it is understood that the wall angle 96 otherwise replicates a scheme such as that previously described at 10 in the preceding drawing figures. It is further understood and contemplated that additional indicia portions of the wall angle previously identified at 10, including such as the story pole markings (i.e., 44, 68, et. seq.) can also be provided as cutouts. Alternatively, it is also contemplated that certain repetitive subsets of measurement indicia can be provided as punch or cutout portions while additional subsets are otherwise provided as non-cutout portions, such as with the previously described indicia writing schemes placed thereon.

Referring back to FIG. 6, additional groupings of substantially circular shaped cut-outs are defined according to the following scheme between a first corresponding end of the wall angle 96 and the 1' marker 98 and are set forth as follows: 3" single aperture 106, 6" double aperture 108, and 9" single aperture 110. Markings existing between the 1' marker 98 and 2' marker 100 include: 15" single aperture 112, 16" single aperture 114, 18" double aperture 116 and 21" single aperture 118. Markings existing between the 2' marker 100 and 3' marker 102 include 27" single aperture 120, 30" double aperture 122, 32" single aperture 124, and 33" single aperture 126. Markings existing between the 3' marker 102 and the 4' marker 104 include 39" single aperture 128, 42" double aperture 130, and 45" single aperture 132.

Following the 4' diamond shaped marker 104, the cutout arrangement illustrated repeats that from between the wall angle end and 1' marker 98 and again includes 51" single aperture 134, 54" double aperture 136, and 57" single aperture 138. Additionally, the various 3" spaced single apertures (106, 110, 118, et. seq.) are arranged along the top of wall angle, and are capable of being utilized to receive nails for mounting the wall angle. Alternatively, the apertures may also be positioned at other vertical positions (such as lower) without departing from the scope of invention. Additionally, an additional and uniquely configured aperture (see rectangular aperture 139) is positioned at a location approximately 52⅜ along the length of the wall angle. The purpose of aperture 139 is to mark an appropriate location for the diagonal intersection point of a 4'×2' rectangular grid.

As is also evident from FIG. 6, certain of the single apertured markings are provided at upper or lower height positions and along the spaced axial increments of the wall angle. Examples again of this include 15" aperture 112 at a lower height position, as well as 16" aperture 114 and 32" aperture 124, both at an elevated height position.

Figure 7:
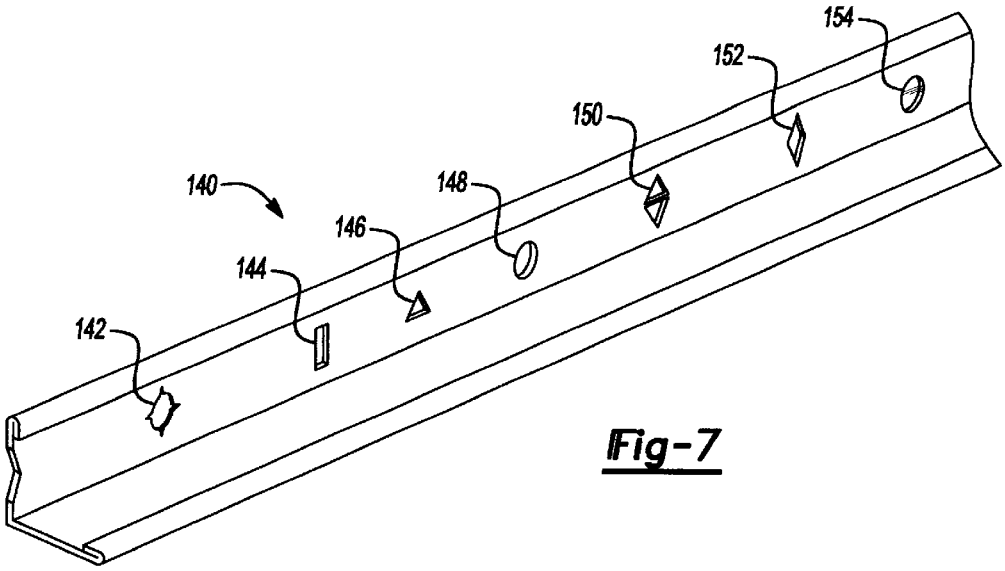
FIG. 7 is an alternate perspective illustration and which exhibits a variety of differing and potential punch-out configurations which may be utilized as measurement markings according to the present invention.
Figure 8:
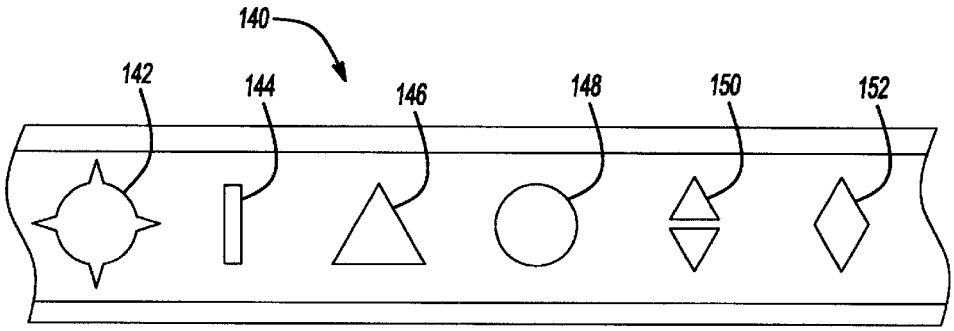
FIG. 8 is a frontal view, in substantially enlarged fashion, of the punch-out measurement scheme of FIG. 7.

Referring finally to FIGS. 7 and 8, a general illustration is given at 140 of a wall angle according to a still further example of the present invention and which contemplates utilizing a variety of additional and different punch-out configurations for identifying any specific measurement intervals set forth along the wall angle 140. In particular, the variety of shapes (formed by punching or die pressing out an annular inner configuration in the selected extending side of the wall angle) include a diamond hole 142, rectangle 144, triangle 146, rounded hole 148, double triangle 150 and diamond 152.

Referring again particularly to FIG. 7, it is also contemplated that, as opposed to completing a punch-out according to a selected shape and configuration, a desired location of the wall angle 140 may be indented only and an example of this is illustrated by indentation 154. It is further contemplated and understood that yet other and additional types of indicia marking can be employed, such as including etching in order to provide the necessary indicia representations.

The conventional manufacturing processes associated with producing typical wall angle are capable of running at approximately 240 lineal foot per minute and it is further envisioned that an appropriate stamping, punching, indenting, etching or other sectioning operation can be incorporated into such a conventional line for manufacturing the wall angle.

Accordingly, the present invention discloses a novel and useful wall angle for use in installing a suspended ceiling grid structure within a walled enclosure and which greatly reduces the time and effort necessary in establishing the necessary measurements for marking the main runner and hanger wire locations, the locations of the wall studs, and the correct height for the location of additional lengths of wall angle and the correct drop height of the main grid runners. Additional preferred applications will become apparent to those skilled in the art to which it pertains and without deviating from the scope of the appended claims.

We claim:

1. A wall angle for use in installing a suspended ceiling grid structure within a walled enclosure, the grid structure including a plurality of main grid runners and hanger wires suspending the main runners from an overhead support of the room enclosure, said wall angle comprising:

an elongated body having, in cross section, a profile with a first side and a second side extending from an interconnecting edge with said first side;

a first interval indicia placed at first selected length intervals along said body and for marking first iterative locations for engagement of the main runners and hanger wires, said first interval indicia further comprising a first series of punch-out shapes designating increments of at least every four feet along said body;

a second interval indicia placed at second selected length intervals along said body and for marking second iterative locations for engagement of said wall angle to the walled enclosure; and a third interval indicia placed at third selected length intervals along said body and for establishing at least one of an overall height and length of the grid structure;

said wall angle being employed in any of a number of different measuring and marking applications to decrease the time necessary to install the suspended ceiling structure.

2. The wall angle as described in claim 1, further comprising said first series of punch-outs designating increments along every foot of said body.

3. The wall angle as described in claim 2, said body defining an angled profile in cross section and said first series of punch-outs exhibiting a substantially diamond-shaped configuration.

4. The wall angle as described in claim 1, said second interval indicia further comprising a second series of punch-out shapes designating increments along every sixteen inches of said body.

5. The wall angle as described in claim 4, said body defining an angled profile in cross section and said second series of punch-outs exhibiting a substantially circular hole arranged at a designated height along a selected side of said elongated body.

6. The wall angle as described in claim 5, said second series of punch-outs being formed at an elevated height location at specified intervals and along said first side of said elongated body.

7. The wall angle as described in claim 1, said third interval indicia further comprising a third series of markings designating increments beginning at an initial established length of seven foot, six inches along said elongated body, and repeating at six inch increments thereafter.

8. The wall angle as described in claim 7, further comprising additional third interval indicia located at further designated increments including seven foot-eleven inches, nine foot-eleven inches and eleven foot-eleven inches.

9. The wall angle as described in claim 8, said third series of interval indicia each being inscribed as a pair of markings along both said first and second sides of said body, said individual pairs of marks being established in opposing and substantially triangular shape.

10. The wall angle as described in claim 9, further comprising incising of selected portions of said elongated body corresponding to a selected pair of said third series of markings, a marking indicia being located in a channel defined by said incisions and resiliently engaged against said body.

11. The wall angle as described in claim 2, further comprising a fourth interval indicia placed at fourth selected length intervals of the grid structure.

12. The wall angle as described in claim 11, said fourth interval indicia further comprising a fourth series of markings alternating with said first series of interval indicia and designating increments of six inches between every foot of said body.

13. The wall angle as described in claim 1, said first and second sides of said body defining, in cross sectional profile, a substantially right angle, and said elongated body being established at individual twelve foot lengths.

14. The wall angle as described in claim 1, said body having a durable and resilient material and being manufactured as a substantially flattened blank wherein said first and second sides are arranged in substantially planar fashion.

15. The wall angle as described in claim 1, at least one of said interval indicia further comprising a sectioned portion taken from a selected side of said elongated body and selected from the group of shapes including, without limitation, diamond holes, rectangles, triangles, rounded holes, double triangles, and diamonds.

16. The wall angle as described in claim 1, at least one of said interval indicia further comprising indented portions impressed into a selected side of said elongated body.

17. The wall angle as described in claim 1, at least one of said interval indicia further comprising etchings into a selected side of said elongated body.

18. A wall angle for use in installing a suspended ceiling grid structure within a walled enclosure, the grid structure including a plurality of main grid runners and hanger wires suspending the main runners from an overhead support of the room enclosure, said wall angle comprising:

an elongate body constructed of a durable material and having, in cross section, an angled profile with a first side and a second side extending from an interconnecting edge with said first side;

a first series of punch-outs defined in said elongated body located at first selected one foot length intervals along said body and for marking first iterative locations for engagement of the main runners and hanger wires;

a second series of punch-outs placed at second selected length intervals along said body and for marking second iterative locations for engagement of said wall angle to vertically extending wall studs of the walled enclosure; and a third series of markings placed at third selected length intervals along said body and for establishing at least one of an overall height and length of the grid structure, said third series of markings each defining a pair of markings provided along both said first and second sides of said body, said individual pairs of marks being established in opposing and substantially polygonal shape;

said wall angle being employed in any of a number of different measuring and marking applications to decrease the time necessary to install the suspended ceiling structure.

19. A wall angle for use in installing a suspended ceiling grid structure within a walled enclosure, the grid structure including a plurality of main grid runners and hanger wires suspending the main runners from an overhead support of the room enclosure, said wall angle comprising:

an elongated body having, in cross section, a profile with a first side and a second side extending from an interconnecting edge with said first side;

a first interval indicia placed at first selected length intervals along said body and for marking first iterative locations for engagement of the main runners and hanger wires;

a second interval indicia placed at second selected length intervals along said body and for marking second iterative locations for engagement of said wall angle to the walled enclosure, said second interval indicia further comprising a second series of punch-out shapes designating increments along every sixteen inches of said body; and a third interval indicia placed at third selected length intervals along said body and for establishing at least one of an overall height and length of the grid structure;

said wall angle being employed in any of a number of different measuring and marking applications to decrease the time necessary to install the suspended ceiling structure.

20. A wall angle for use in installing a suspended ceiling grid structure within a walled enclosure, the grid structure including a plurality of main grid runners and hanger wires suspending the main runners from an overhead support of the room enclosure, said wall angle comprising:

an elongated body having, in cross section, a profile with a first side and a second side extending from an interconnecting edge with said first side;

a first interval indicia placed at first selected length intervals along said body and for marking first iterative locations for engagement of the main runners and hanger wires;

a second interval indicia placed at second selected length intervals along said body and for marking second iterative locations for engagement of said wall angle to the walled enclosure; and a third interval indicia placed at third selected length intervals along said body and for establishing at least one of an overall height and length of the grid structure, said third interval indicia further comprising a third series of markings designating increments beginning at an initial established length of seven foot, six inches along said elongated body, and repeating at six inch increments thereafter, additional third interval indicia located at further designated increments including seven foot-eleven inches, none foot-eleven inches and eleven foot-eleven inches, said third series of interval indicia each being inscribed as a pair of markings along both said first and second sides of said body, said individual pairs of marks being established in opposing and substantially triangular shape;

said wall angle being employed in any of a number of different measuring and marking applications to decrease the time necessary to install the suspended ceiling structure.

21. A wall angle for use in installing a suspended ceiling grid structure within a walled enclosure, the grid structure including a plurality of main grid runners and hanger wires suspending the main runners from an overhead support of the room enclosure, said wall angle comprising:

an elongated body having, in cross section, a profile with a first side and a second side extending from an interconnecting edge with said first side;

a first interval indicia placed at first selected length intervals along said body and for marking first iterative locations for engagement of the main runners and hanger wires;

a second interval indicia placed at second selected length intervals along said body and for marking second iterative locations for engagement of said wall angle to the walled enclosure;

a third interval indicia placed at third selected length intervals along said body and for establishing at least one of an overall height and length of the grid structure; and at least one of said interval indicia further comprising a sectioned portion taken from a selected side of said elongated body and selected from the group of shapes including, without limitation, diamond holes, rectangles, triangles, rounded holes, double triangles, and diamonds;

said wall angle being employed in any of a number of different measuring and marking applications to decrease the time necessary to install the suspended ceiling structure.

* * * * *